US008105464B2

(12) United States Patent
Danielsson et al.

(10) Patent No.: US 8,105,464 B2
(45) Date of Patent: Jan. 31, 2012

(54) DISTRIBUTION DEVICE FOR FEEDING OF CELLULOSE PULP

(75) Inventors: Magnus Danielsson, Matfors (SE); Jorgen Lundberg, Sundsvall (SE); Olof Melander, Sundsvall (SE)

(73) Assignee: Metso Paper Inc., Helsinki (FI)

( * ) Notice: Subject to any disclaimer, the term of this patent is extended or adjusted under 35 U.S.C. 154(b) by 0 days.

(21) Appl. No.: 12/988,311

(22) PCT Filed: Apr. 21, 2009

(86) PCT No.: PCT/SE2009/050407

§ 371 (c)(1), (2), (4) Date: Oct. 16, 2010

(87) PCT Pub. No.: WO2009/131527

PCT Pub. Date: Oct. 29, 2009

(65) Prior Publication Data

US 2011/0042026 A1 Feb. 24, 2011

(30) Foreign Application Priority Data

Apr. 23, 2008 (SE) ..... 0800933

(51) Int. Cl.
*D21F 11/00* (2006.01)

(52) U.S. Cl. ..... 162/202; 162/289; 162/301; 162/361

(58) Field of Classification Search ..... 162/202, 162/289, 301, 361, 358.3; 210/236, 386
See application file for complete search history.

(56) References Cited

U.S. PATENT DOCUMENTS 6,306,259 B1 * 10/2001 Lamas et al. ..... 162/301
6,668,600 B1 * 12/2003 Hansson ..... 68/43
2002/0124977 A1 * 9/2002 Brottgardh et al. ..... 162/56

FOREIGN PATENT DOCUMENTS

WO WO 00/75419 * 12/2000

* cited by examiner

*Primary Examiner* — Mark Halpern
(74) *Attorney, Agent, or Firm* — Rolf Fasth; Fasth Law Offices

(57) ABSTRACT

A device is provided for distribution of 2-13% cellulose pulp to a movable processing surface in a pulp processing device to form a pulp web thereon. An inlet box has an inlet and an outlet defined therein. A rotatable distribution means is arranged for distributing pulp along an entire length of the outlet. The distribution means is placed so that a first distance (a1) between the distribution means and a first outlet wall is greater than a second distance (a2) between the distribution means and a movable processing surface.

9 Claims, 1 Drawing Sheet

DISTRIBUTION DEVICE FOR FEEDING OF CELLULOSE PULP

PRIOR APPLICATION

This application is a U.S. national phase application based on International Application No. PCT/SE2009/050407, filed 21 Apr. 2009 that claims priority from Swedish Patent Application No. 0800933-4, filed 23 Apr. 2008.

TECHNICAL FIELD

The present invention relates to a device for distribution of cellulose pulp to a pulp web at a pulp processing device.

BACKGROUND AND SUMMARY OF THE INVENTION

In pulp processing devices such as for example presses, cellulose pulp is fed to a pulp web which extends around the press, whereby the cellulose pulp is gradually dewatered along the entire pulp web and preferably the pulp is pressed at the end of the pulp web for further dewatering to desired consistency. Subsequently, it is transported to the next step.

Usually the pulp is pressurised along the entire pulp web and introduced to the pulp web at a certain increased pressure. Two main reasons that the pulp conventionally has been introduced to the pulp web at an increased pressure, i.e. higher than atmospheric pressure, is firstly that thereby a uniform distribution along the entire width of the pulp web is achieved, since the high pressure facilitates forcing the pulp onto the entire width of the web. A second reason is that with the high pressure a more efficient dewatering of the cellulose pulp is accomplished already in the initial part of the pulp web. The high initial pressure has thereby resulted in an improved dewatering of the pulp.

There are, however, problems related to the high pressure. One problem is that the high pressure results in a limitation of the amount of pulp that may be dewatered along a pulp web per time unit. In fact, it has been shown that the pressure builds up along the entire pulp web to continuously increase towards and being topmost at the end of the pulp web, i.e. the nip. Another problem is that it costs energy to pressurise the cellulose pulp to the desired pressure. Moreover a pump and accompanying pipes are needed to build up the pressure and to transport the pressurised pulp to the inlet box. Up to now, no device exists by which one can reliably and without substantial pressure drop distribute pulp to a processing surface to form a pulp web on the same.

In the Swedish patent document 516 335 a device is described for feeding of cellulose pulp in the form of a pulp web. At this device the outlet includes restrictions in the form of holes which are arranged along the generator of the envelope surface of the inlet box. The holes are preferably arranged so that their diameter is smaller than the distance between them. In that way, the pressure is maintained in the inlet box such that the pulp is forced out of the outlet and is uniformly distributed along the width of the pulp web. The said device thus requires a fairly high input pressure to the inlet box, since the pressure drop over the restrictions will be significant.

An object of the invention is to obtain an improved device for distribution of cellulose pulp to a pulp web at a pulp processing device, which device does not show the problems which are present in conventional devices and which are described above.

The said object is achieved by the device as disclosed in the claims, which device is intended for distribution of cellulose pulp with a concentration of 2-13% to a movable processing surface in a pulp processing device to form a pulp web on the said surface, which pulp web is transported with the movable processing surface in a first direction D1, whereby the distribution device comprises:

an inlet box comprising an inlet for incoming cellulose pulp to the inlet box and an outlet for transferring of the cellulose pulp to the pulp web, which outlet opens towards the pulp web and has a length L that corresponds to the width of the pulp web, and which outlet has a width which is delimited by a first long wall and a second long wall which is opposite to and essentially parallel to the first long wall, a rotating distribution means which is arranged to distribute the cellulose pulp along substantially the entire length of the outlet, and which is arranged between the long walls of the outlet, The distribution means is so placed that a first distance a1 between the distribution means and the first outlet wall is larger than a second distance a2 between the distribution means and the movable processing surface.

The invention also relates to a method for distribution of cellulose pulp having a concentration of 2-13% to a pulp web on a movable processing surface in a pulp processing device, which processing surface is moved in a first direction D1, whereby the method comprises the steps of:

feeding cellulose pulp to an inlet box having an outlet which opens towards the pulp web and has a length L which corresponds to substantially the entire width of the movable processing surface, whereby the outlet has a width which is delimited by a first long wall and a second opposed and in relation to the first wall essentially parallel long wall;

by a distribution means in the inlet box distributing the cellulose pulp along substantially the entire width of the pulp web;

Further, the cellulose pulp is let through the outlet to the pulp web essentially unimpededly, thanks to the distribution means being placed such that a distance a1 between the distribution means and the first outlet wall is larger than a second distance a2 between the distribution means and the movable processing surface.

Thanks to the above described device and method there is no need to feed the cellulose pulp at an increased pressure to the inlet box, whereby the device requires fewer parts, since no pump with accompanying pipes are needed, and since it may be operated at a lower energy consumption. Thus, it becomes cheaper to implement as well as to operate. In addition to a simplification of the feeding to the inlet box the operation of the inlet box becomes safer and the risk of pulp build-up becomes minimal.

The invention also relates to a pulp processing device, comprising the above described device for distribution of cellulose pulp. The pulp processing device may for example have a movable processing surface formed by a rotating roll or a movable processing surface formed by a plane wire.

BRIEF DESCRIPTION OF THE DRAWINGS

The invention, together with further objects and advantages thereof, are best understood with reference to the accompanying description and the enclosed drawings, of which.

DETAILED DESCRIPTION

Figure 1:
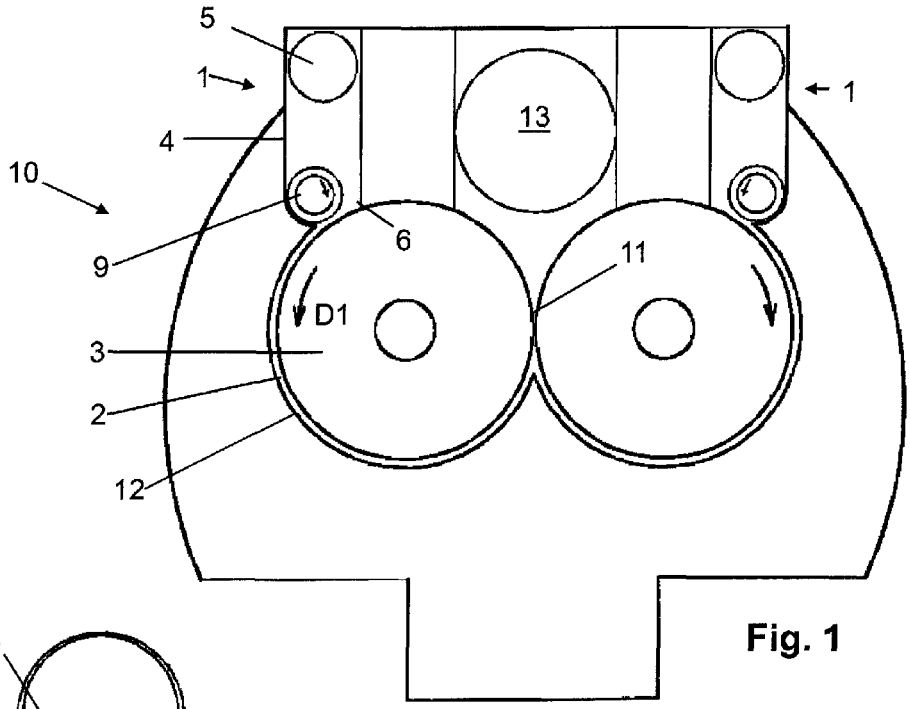
FIG. 1 shows a schematic view of a wash press in which two distribution devices according to the invention are used.

In the drawings, similar and corresponding details are indicated by the same reference signs.

While the present invention has been described in accordance with preferred compositions and embodiments, it is to be understood that certain substitutions and alterations may be made thereto without departing from the spirit and scope of the following claims.

FIG. 1 shows a device 1 for distribution of cellulose pulp to a pulp web 2 in a pulp processing device 10. The incoming pulp has a concentration of 2-13%. In the embodiment shown, the pulp web 2 is delimited on the one side by a movable processing surface 3*a* on a rotating roll 3 and on the other side by a trough or guide surface 12 and is transported in a direction D1 with the roll 3. The pulp web 2 is dewatered on the movable processing surface 3*a,* which is perforated allowing filtrate to pass through the surface. The pulp web 2 is continuously dewatered as far as to a nip 11 where the pulp web ends and the dewatered pulp is removed by means of a distribution screw 13.

In the illustrated embodiment two rolls, each having a distribution device 1 with an inlet box, are placed next to each other, whereby the nip 11 is formed where the two rolls are the closest to each other. The invention is however also suitable for devices wherein only one roll is used, or another type of device wherein a pulp web is formed, such as a double wire dewatering press, e.g. with a dewatering/wire table. In a double wire dewatering press (not shown), the pulp web is formed between two opposing wires, through which filtrate may pass. The wires are typically supported by a dewatering/wire table, wedge plates, or the like in an initial dewatering zone. Thus, the movable processing surface according to the present invention could be formed by a plane wire instead of a roll. The distribution device 1 may however be the same.

The distribution device 1 comprises an inlet box 4, in which the distribution of cellulose pulp to the entire width of the pulp web 2 takes place. The pulp enters into the inlet box 4 via an inlet 5 which in the embodiment shown is situated above the middle of the pulp web. It is however also possible to arrange the inlet closer to one of the ends of the inlet box or to arrange several inlets which are suitably distributed along the length and the width of the inlet box. The main task of the distribution device 1 in the inlet box 4 is to make sure that the pulp is evenly distributed over the entire width of the pulp web 2.

Conventionally, the pulp has been distributed by one or two distribution screws which are arranged with a relatively tight fit inside an inlet box. The tight fit has been considered a prerequisite in many conventional devices since the pulp web has been formed by pressing pulp out to a processing surface In order for a distribution screw to function satisfactorily, it has further been considered advantageous to exert a certain pressure on the material around the distribution screw such that the material is fed continuously and such that no cavities are formed in the area around the distribution screw.

A distribution means 9 is arranged, which in the embodiment shown consists of a feed screw. Due to the inventive design of the device, it is however not necessary that the distribution is effected by a feed screw. The distribution means 9 according to the invention has as its main object to distribute the pulp evenly over the entire width of the pulp web, but it has also a stirring effect and it is therefore possible to use other types of distributing devices. Preferably however, the distribution means 9 should be composed of a longitudinal rotating means.

It is also possible to use two distribution means; a first distribution means which may consist of a feed screw and is arranged to distribute the pulp evenly inside the inlet box, and a second, lower distribution means 9 which corresponds to the inventive distribution means and which is arranged to distribute the pulp to the pulp web. it is however preferable, as in the embodiment shown, to have only one rotating distribution means which performs both of these functions. The design of the distribution means is naturally dependent on the geometry of the inlet box, and of the placement of the inlet and the outlet. In the embodiment shown, the inlet is centrally arranged at the highest point of the inlet box, whereby a distribution means in the form of a feed screw may be used which has two threads 9*a* and 9*b* respectively, which are intended to distribute the pulp in different directions. However, to a person skilled in the art it is obvious to design the distribution screw such that the pulp is distributed inside the inlet box in the manner intended. The invention is instead first and foremost directed to the position of the distribution means 9, which will be described more in detail below.

In order for the feed screw to distribute the pulp efficiently in the inventive device, it should preferably be situated below a contemplated minimum level, below which the inlet box shall be continuously filled with pulp so that the intended distributing and stirring effect is obtained. The distribution device 1 comprises an outlet 6 for the distributed, cellulose pulp. The outlet 6 extends along substantially the entire width of the pulp web 2 perpendicular to the longitudinal direction of the pulp web. The outlet 6 is placed downstream of the distribution means 9 and connects the inside of the inlet box 4 to the beginning of the pulp web 2. The outlet 6 has such a form and width that the cellulose pulp may be transported essentially unimpededly and without pressure drop through the outlet to the processing surface 3*a*.

According to the embodiment shown, the outlet 6 opens towards the processing surface 3*a* and has a length L which corresponds to essentially the entire width of the roll 3. It has a width which is delimited by a first long wall 7 and a second opposed and essentially parallel long wall 8. The rotating distribution means 9 is arranged between the long walls 7 and 8, respectively, of the outlet 6.

According to the embodiment shown, the inlet box 4 is placed essentially above the pulp web 2, whereby the cellulose pulp is arranged to flow downwards substantially freely through the outlet to the processing surface 3*a* to form the pulp web. Due to this design the pressure drop through the inlet box becomes minimal, such that the inlet pressure into the inlet box is essentially the same as the outlet pressure from the inlet box. Thereby, no pressure is needed in order to transport the pulp through the inlet box and since the inlet according to the device shown is arranged at the highest point of the inlet box the performance of the distribution means is sufficient for the pulp to flow through the inlet box and form the pulp web. In case the inlet is not arranged at the highest point of the inlet box a certain pressure will be needed to feed the pulp into the inlet box and to fill the same. There is however no need for an increased pressure inside the inlet box itself.

Figure 2:
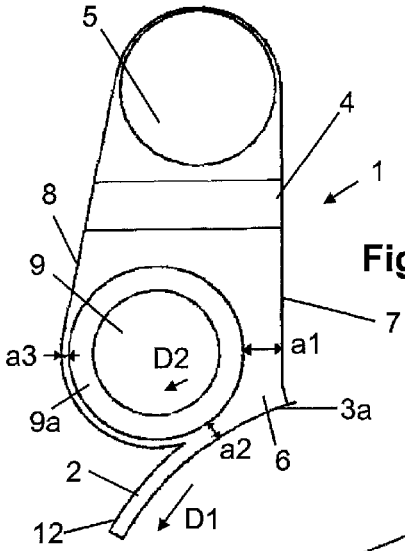
FIG. 2 shows a distribution device according to the invention from the side and partly in cross section.
Figure 3:
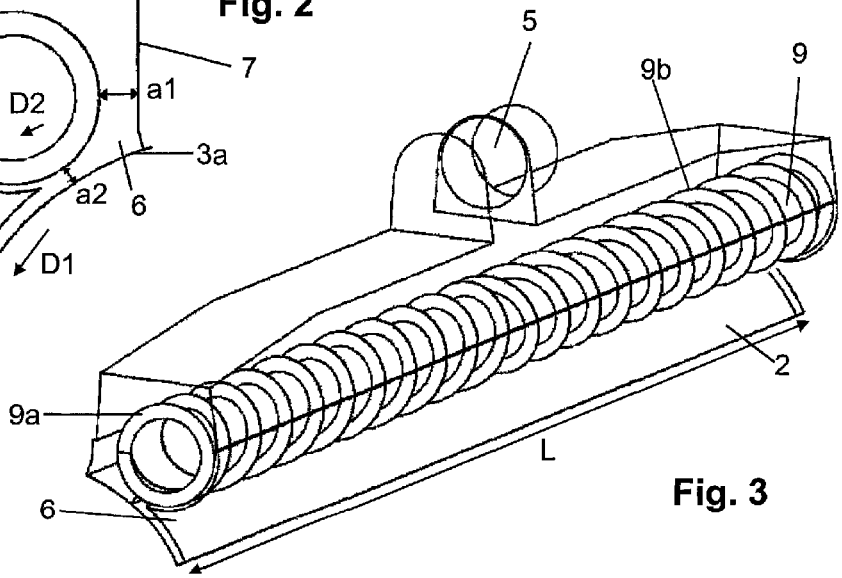
FIG. 3 shows a perspective view of an embodiment of the distribution device according to the invention partly in cross section.

As is evident from the FIGS. 2 and 3, the distribution means 9 according to the embodiment shown of a single distribution screw which, by means of the threads 9*a* and 9*b,* is intended to transport the pulp from the inlet at the middle of the inlet box and out towards the edges of the inlet box, whereby the distribution means 9 is so placed that a distance a1 between the peripheral surface of the distribution means 9, i.e. the outer edge of the threads, and the first outlet wall 7 is larger than a second distance a2 between the peripheral surface of the distribution means 9 and the processing surface 3*a* of the roll 3. Thereby, the pulp can move relatively unimpededly along the first outlet wall 7 past the distribution means 9. In addition thereto, since the distance a2 between the distribution means 9 and the roll 3 is smaller than the distance a1 between the distribution means 9 and the first outlet wall 7, the pulp is pressed together somewhat already at the beginning of the pulp web.

Further, the distribution means is arranged close to the other outlet wall 8 such that a third distance a3 between the distribution means 9 and the second outlet wall 8 is essentially smaller than both a1 and a2. The distance a3 only has to be so large as to guarantee that the distribution means does not touch the second outlet wall 8. The smaller this distance a3 is, the smaller amount of pulp is given an opportunity to return into the inlet box with the distribution means 9 and the larger amounts of material are distributed to the pulp web. It is thus advantageous if a3 is essentially smaller than a2, such that as little as possible of the pulp that passes through the space delimited by the distance a2 returns into the space delimited by the distance a3.

The gap between the trough 12 and the processing surface 3*a* of the roll 3 which delimits the thickness of the pulp web 2 is suitably slightly smaller than the distance a2 between the distribution means 9 and the processing surface 3*a* of the roll 3, and smaller than approximately half of the distance a1 between the distribution means 9 and the first outlet wall 7. Conveniently, the distance a2 between the distribution means 9 and the processing surface 3*a* of the roll 3 is at most three times as large as the gap between the trough 12 and the processing surface 3*a* of the roll 3, and preferably it is at most twice as large.

In a typical embodiment of the device according to the invention, the distance a1 between the distribution means 9 and the first outlet wall 7 may be approximately 50-200 mm, the distance a2 between the distribution means 9 and the peripheral surface of the roll 3 being approximately 30-100 mm, and whereby the third distance a3 between the distribution means 9 and the second outlet wall 8 being designed to be as small as possible and for example being approximately 10 mm. The roll 3 further has a diameter of approximately 700-2,500 mm and rotates about 5-20 revolutions per minute, whereas the distribution means 9 has a diameter of about 350 mm and rotates about 75-150 revolutions per minute. The thickness of the pulp web, which in the embodiment shown is delimited by the trough 12 and the processing surface 3*a* of the roll 3 is usually between 20 and 100 mm, preferably about 30-60 mm.

All quantities/magnitudes are however parameters that may be adapted by the person skilled in the art depending on the type of production one wishes to achieve etc. However, relevant to the invention is the relative ratio between some of these quantities/magnitudes.

Preferably the distribution means 9 rotates in the opposite direction D2 with respect to the direction of rotation D1 of the roll 3, such that their respective peripheral surfaces move in the same direction in the space which is formed between them whereby the pulp web can be formed in this space. It may also be favourable to let the distribution means 9 rotate at such a speed in relation to the roll 3 that the peripheral surface of the distribution means 9 moves faster than the processing surface 3*a* of the roll 3. Their respective speeds of rotation are, as suggested above, however a matter of adjustment and are regulated depending on for example the concentration of the pulp. At low consistencies, i.e. about 2-7%, the peripheral surface of the distribution means 9 and the processing surface 3*a* of the roll 3 may be moved at essentially the same speed. The higher the concentration of the pulp is the larger will however the need for forced distribution be, which may be obtained by letting the distribution means rotate faster.

In certain applications it may be desirable that the pulp has a certain overpressure, for which reason the inlet box may be designed such that it can be pressurised. Apart from that, it may however be designed equally to the case where it is not to be pressurised and its advantages will basically be the same, whereby the pressure drop through the inlet box will be essentially zero.

According to an advantageous embodiment of the invention there is a storage silo arranged in direct connection to and preferably above the inlet box. In that case the feeding of the pulp to the inlet box may be easily controlled by regulating a valve device such that the pulp never goes below a certain minimal level in the inlet box. Preferably one tries to keep the inlet box well-filled and suitably completely full. Thereby the pulp, with the assistance of the performance of the distribution means, will be distributed over the entire width of the pulp web.

The invention also relates to a method for distribution of cellulose pulp having a concentration of 2-13% to a pulp web 2. The method comprises the step of feeding cellulose pulp to an inlet box 4. Subsequently the cellulose pulp is distributed by the distribution means 9 of the inlet box 4 along essentially the entire width of the pulp web 2. Next the cellulose pulp is let through the outlet 6 to the pulp web 2 essentially unimpededly. This is achieved thanks to the distribution means 9 being placed such that the first distance a1 between the distribution means 9 and the first outlet wall is larger than the second distance a2 between the distribution means 9 and the peripheral surface of the roll 3.

The invention has been described with reference to an exemplifying embodiment. To a person skilled in the art it is however obvious that the invention may be designed in a large number of ways without departing from the inventive thought or its scope of protection, which is only limited by the enclosed claims.

The invention claimed is:

1. A device for distribution of cellulose pulp having a concentration of 2-13% to a movable processing surface in a pulp processing device to form a pulp web on the processing surface, the pulp web being transported together with the processing surface in a first direction (D1), comprising:

an inlet box having an inlet (5) defined therein for incoming cellulose pulp to the inlet box, an outlet for transferring the cellulose pulp to the pulp web, the outlet facing the pulp web the outlet having a length (L) corresponding to a width of the pulp web, the outlet having a width delimited by a first long wall and a second opposed long wall, the second long wall being essentially parallel to the first long wall;

a rotatable distribution means for distributing the cellulose pulp along essentially the entire length (L) of the outlet, the rotatable distribution means being arranged between the first long wall and the second long wall;

the rotatable distribution means being placed so that a first distance (a1) between the distribution means and the first long wall is greater than a second distance (a2) between the distribution means and the processing surface.

2. The device according to claim 1 wherein the distribution means is so placed that a third distance (a3) between the distribution means and the second long wall is essentially smaller than the second distance (a2).

3. The device according to claim 1 wherein the distribution means (9) is rotatable in a direction (D2) with respect to a direction of rotation (D1) of the processing surface such that a peripheral surface of the distribution means is movable in the same direction as the processing surface in a space formed there between.

4. The device according to claim 3 wherein the distribution means is rotatable at such a speed that the peripheral surface is movable faster than the processing surface.

5. The device according to claim 1 wherein a thickness of the pulp web is delimited on one side by a rotatable roll and on another side by a trough.

6. The device according to claim 5 wherein the distance (a2) is at most three times as large as the thickness of the pulp web.

7. The device according to claim 6 wherein the distance (a2) is at most twice as large as the thickness of the pulp web (2).

8. The device according to claim 1 wherein the inlet box is placed essentially above the pulp web.

9. A method for distributing cellulose pulp having a concentration of 2-13% to a pulp web on a movable processing surface in a pulp processing device, comprising:

moving the processing surface in a first direction (D1), feeding cellulose pulp to an inlet box having an outlet defined therein facing the pulp web, providing the inlet box with a length (L) corresponding essentially to an entire width of the processing surface, providing a distribution means disposed at a distance (a1) from a first outlet wall, the distance (a1) being greater than a second distance (a2) extending between the distribution means and the processing surface, the distribution means distributing the cellulose pulp along essentially an entire width of the pulp web (2), the distribution means allowing the cellulose pulp to pass essentially unimpededly through the outlet to the pulp web.

* * * * *